US006062411A

United States Patent [19]

Garland, Jr.

[11] Patent Number: 6,062,411

[45] Date of Patent: May 16, 2000

[54] APPARATUS FOR ORGANIZING ARTICLES INSIDE A PORTABLE COOLER

[76] Inventor: David J. Garland, Jr., 26 Wheatfield Cir., Fairport, N.Y. 14450

[21] Appl. No.: 09/156,974

[22] Filed: Sep. 18, 1998

[51] Int. Cl.[7] ..... B65D 21/02; F25D 3/08

[52] U.S. Cl. ..... 220/23.4; 62/457.1; 62/459; 193/25 FT; 206/545; 211/71.01; 220/23.88; 220/529; 220/592.15; 220/915.1; 248/128

[58] Field of Search ..... 220/23.4, 23.2, 220/23.88, 23.89, 592.01, 592.02, 592.03, 592.15, 592.23, 485, 493, 495, 915.1, 915.2, 528, 529, 549, 676; 206/545, 758; 62/457.1, 457.2, 457.5, 459, 463; 211/71.01, 85.26, 85.29, 162; 248/307, 310, 298.1, 311.2, 128, 346.03, 346.06, 70

[56] References Cited

U.S. PATENT DOCUMENTS

| | | | |
|---|---|---|---|
| 215,903 | 5/1879 | Ford et al. | 220/592.15 |
| 364,476 | 6/1887 | Boyd | 220/592.15 |
| 581,959 | 5/1897 | Hohoff | 211/44 |
| 664,117 | 12/1900 | Bates | 220/495 |
| 1,487,710 | 3/1924 | Bliss | 220/592.13 |
| 1,681,110 | 8/1928 | Friedman | 206/199 |
| 1,704,048 | 5/1929 | Reeder | 248/312 X |
| 2,512,502 | 6/1950 | Paschell | 248/312 X |
| 2,555,126 | 5/1951 | Greve | 206/545 |
| 2,711,830 | 6/1955 | Howell | 211/75 |
| 3,001,678 | 9/1961 | Maxwell | 248/312 X |
| 3,298,194 | 1/1967 | Hutchinson | 62/294 |
| 3,521,777 | 7/1970 | Vik | 414/608 |
| 4,170,082 | 10/1979 | Freedman | 220/23.4 X |
| 4,307,581 | 12/1981 | Reid | 62/457 |
| 4,403,483 | 9/1983 | Lisalda | 62/457 |
| 4,542,930 | 9/1985 | Adams | 294/160 |
| 4,551,988 | 11/1985 | Petrantoni | 62/457 |
| 4,655,052 | 4/1987 | Garcia | 62/441 |
| 4,759,467 | 7/1988 | Byrne | 220/404 |
| 4,860,896 | 8/1989 | Snider | 206/427 |
| 4,905,949 | 3/1990 | Cosgrove | 248/312.1 |
| 4,916,923 | 4/1990 | Adams et al. | 62/457.1 |
| 4,974,426 | 12/1990 | Gomez et al. | 62/457.7 |
| 5,024,067 | 6/1991 | Maier, II | 62/457.4 |
| 5,437,165 | 8/1995 | White et al. | 62/465 |
| 5,522,239 | 6/1996 | Schwartz et al. | 62/457.5 |
| 5,816,432 | 10/1998 | Hammen et al. | 220/530 |
| 5,896,729 | 4/1999 | Bell et al. | 53/471 |
| 5,953,931 | 9/1999 | Brittain | 62/272 |

*Primary Examiner*—Allan N. Shoap
*Assistant Examiner*—Joe Merek
*Attorney, Agent, or Firm*—Hodgson, Russ, Andrews, Woods & Goodyear, LLP

[57] ABSTRACT

A cooler insert for organizing articles inside a cooler. The insert is adapted for receiving tubular members. The tubular members are sized to hold beverage containers such as two liter bottles and the like. The insert provides an interconnecting structure for arranging the tubular members in modular fashion.

6 Claims, 3 Drawing Sheets

APPARATUS FOR ORGANIZING ARTICLES INSIDE A PORTABLE COOLER

FIELD OF INVENTION

The present invention relates to portable coolers, and more particularly to an insert for organizing articles inside a portable cooler.

BACKGROUND OF THE INVENTION

It is common when packing a portable cooler for a picnic or other event to include large containers of beverages. While twelve-ounce cans are well-suited for use in a cooler, many people, including small children, cannot or do not want to consume an entire twelve-ounce beverage. Accordingly, one and two liter bottles of beverages which are typically sold in cylindrical-shaped plastic containers are often preferable to the aluminum cans. One of the problems associated with using these containers is storing them in a portable cooler. Normally, they are placed at the bottom or middle of the cooler and ice is filled in all around and over them. Once the container is removed from the portable cooler, in order to dispense a serving of the beverage, it can be quite difficult to return the containers into the cooler, especially if the cooler is packed with a lot of ice.

There have been attempts to provide structures for the inside of portable coolers for segregating articles inside the coolers. U.S. Pat. No. 4,307,581 discloses a cooler insert having a rectangular tubular shape with a set of rails on the inside for supporting sliding shelves. The insert does not accommodate different numbers and sizes of bottles sufficiently as the shape of the insert cannot adjust to the number or shape of the bottles. Accordingly, there can be wasted space and inefficient cooling.

U.S. Pat. No. 5,437,165 discloses a food organizing insert for portable ice chests. The insert has some drawbacks, including the space required by the planar surface and the legs for this type of insert. Also, if only a portion of the insert is needed, the remaining portion takes up space that could be available for additional ice to be placed in the ice chests. Finally, the costs of manufacture associated with this product are significant due to the number of parts and the assembly of the parts.

Accordingly, what is needed is an insert for organizing articles inside a portable cooler that is adapted for use with one and two liter bottles and that has a modular design for ease of use and ease of manufacture.

SUMMARY OF THE INVENTION

The present invention meets the above-described need by providing a modular system of interconnecting tubular members suitable for use in a portable cooler. The tubular members are connected by an interconnecting structure such as a base or male/female quick connectors or the like.

In the preferred embodiment, a base having a channel defined therein provides an interconnecting structure for a plurality of tubular members. The tubular members have a flange at one end that fits into the channel on the base. The tubular members slide onto the base from either of two open ends. The base may be equipped with several channels disposed side by side. The tubular members are capable of sliding in the channels from one end to the other. Accordingly, the base provides a structure for interconnecting the tubular members and for providing stability to the tubular members once the cooler or ice chest is loaded with ice.

In an alternate embodiment, the interconnecting structure is provided by male/female quick connectors. The quick connectors comprise snap fitting male and female connectors that are preferably molded integrally onto the tubular members. The quick connectors are preferably disposed on more than one side of the tubular members such that the tubular members can be connected into groups of two or more.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
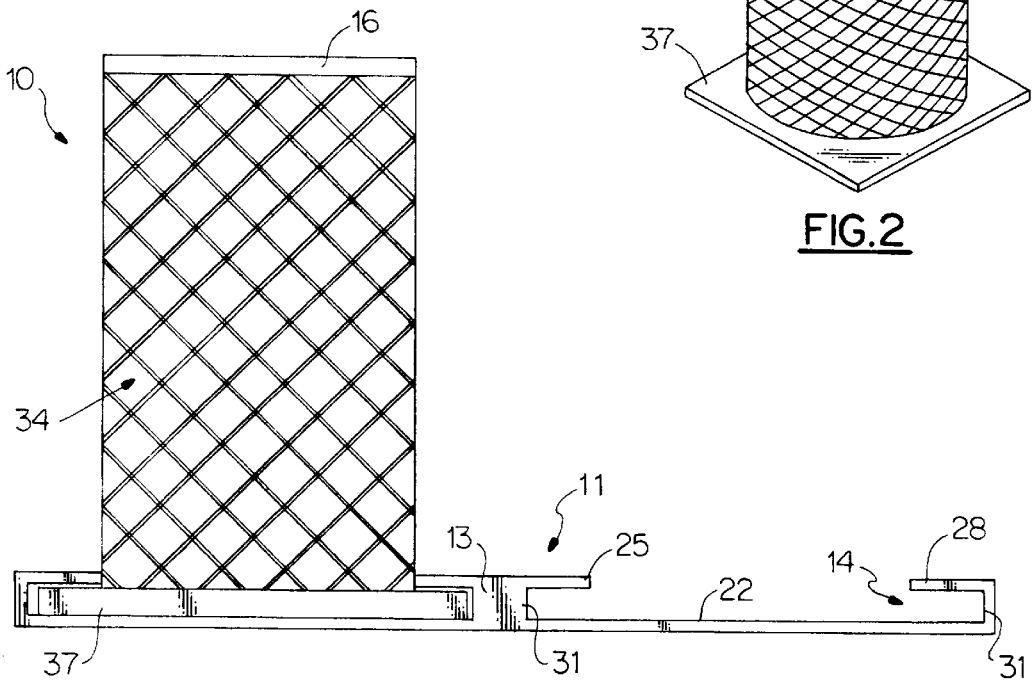
FIG. 1 is a front elevational view of the present invention.

In FIG. 1, a cooler insert 10 has an interconnecting structure 11 in the form of a base 13. The base 13 holds a tubular member 16. The base 13 is preferably manufactured from a molded thermoplastic material as known to those skilled in the art. The base 13 contains a channel 19 that is integrally formed therein. The channel 19 is formed between a bottom planar surface 22 and a pair of opposing protruding members 25, 28. The protruding members 25, 28 are disposed substantially parallel to the bottom surface 22. The protruding members 25, 28 are supported by support members 31 that are disposed normal to the bottom surface 22. The channel 19 is open at opposite ends and allows free movement from one end to the other. The movement is constrained, however, substantially to a horizontal plane. More than one channel 19 can be formed in the base 13 and the channels 19 are disposed side by side such that the base 13 provides a structure for interconnecting several of the tubular members 16 and maintaining them in a desired spatial relationship.

The protruding members 25, 28; the support member 31; and the bottom surface 22 are integrally molded as parts of the base 13. However, these members 25, 28 and 31 could be attached to the planar surface 22 by fasteners, adhesives, and the like.

Figure 2:
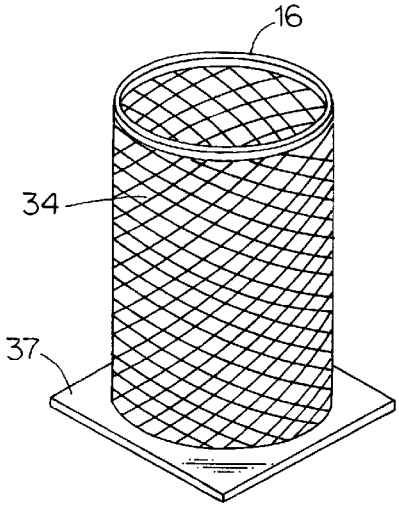
FIG. 2 is a perspective view of the base of the present invention.

Turning to FIG. 2, the tubular member 16 has a plurality of apertures 34 arranged in a basket weave. The apertures 34 provide a pathway for cooling air, but also provide a barrier to keep the ice out of the space inside the tubular members 16. The tubular member 16 also has a flange 37 disposed at an end. The flange 37 is preferably square so that the tubular member 16 can be inserted into the channel 19 from any of its sides. Other shapes, including round, would also be suitable.

Figure 3:
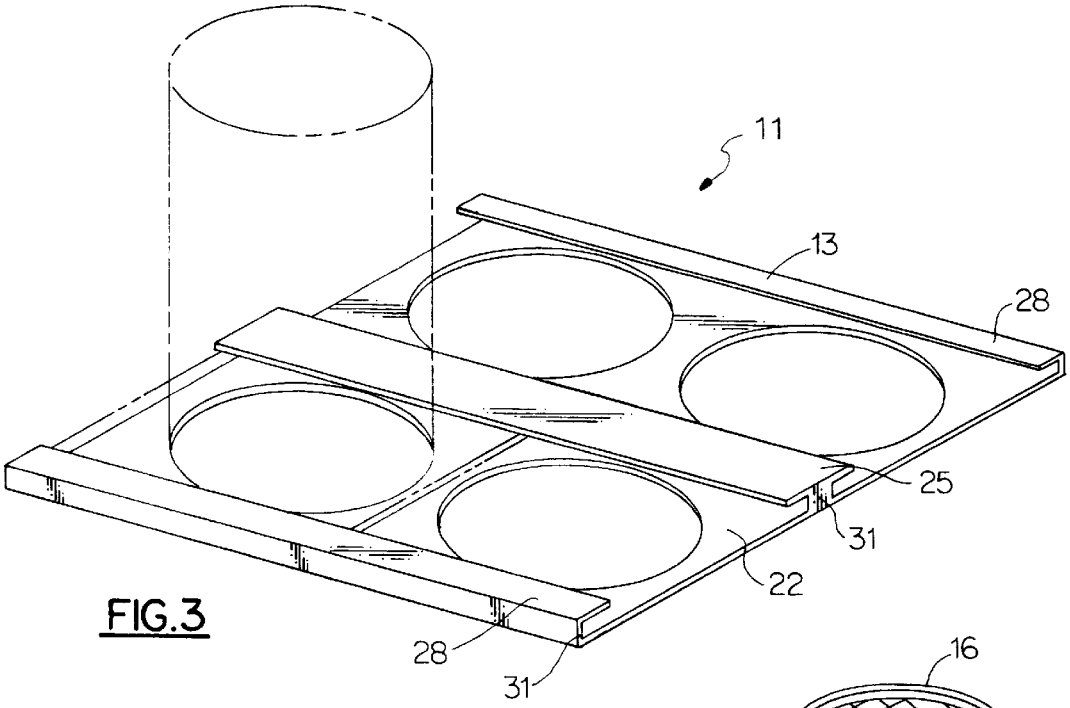
FIG. 3 is a perspective view of the tubular member of the present invention.

In FIG. 3, the base 13 is shown with positions for up to four tubular members 16. The base 13 is rigid and has a relatively wide footprint to prevent the tubular members 16 from tipping over inside a cooler 40 (shown in FIG. 4). The base 13 can be provided with between one to four tubular members 16 depending on the user's needs, however, the number of tubular members 16 for a given container size is only limited by the amount of space inside the cooler 40. Once the base 13 is configured with the tubular members 16, it is placed inside the portable cooler 40, as shown in FIG. 4.

Figure 4:
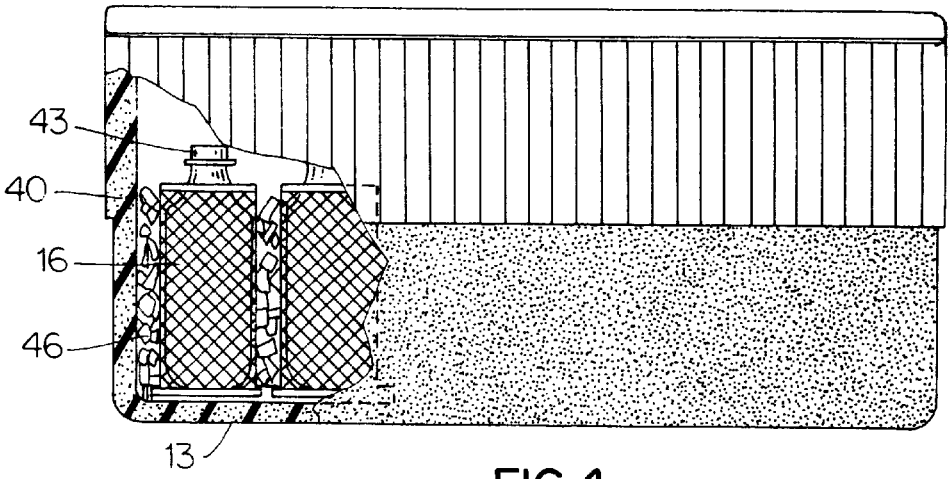
FIG. 4 is a cutaway side view of a portable cooler with the cooler insert of the present invention.

In FIG. 4, the cooler insert 10 has been configured with a predetermined number of tubular members 16 and has been placed inside the portable cooler 40. Next, a two liter plastic container 43 is placed inside the tubular member 16. Finally, ice 46 or other cooling media is placed over the base 13 and around the tubular members 16. Accordingly, the container 43 can be inserted and removed from the cooler 40 without the problem of ice 46 occupying the space for the container 43, when the container 43 is removed.

Figure 5:
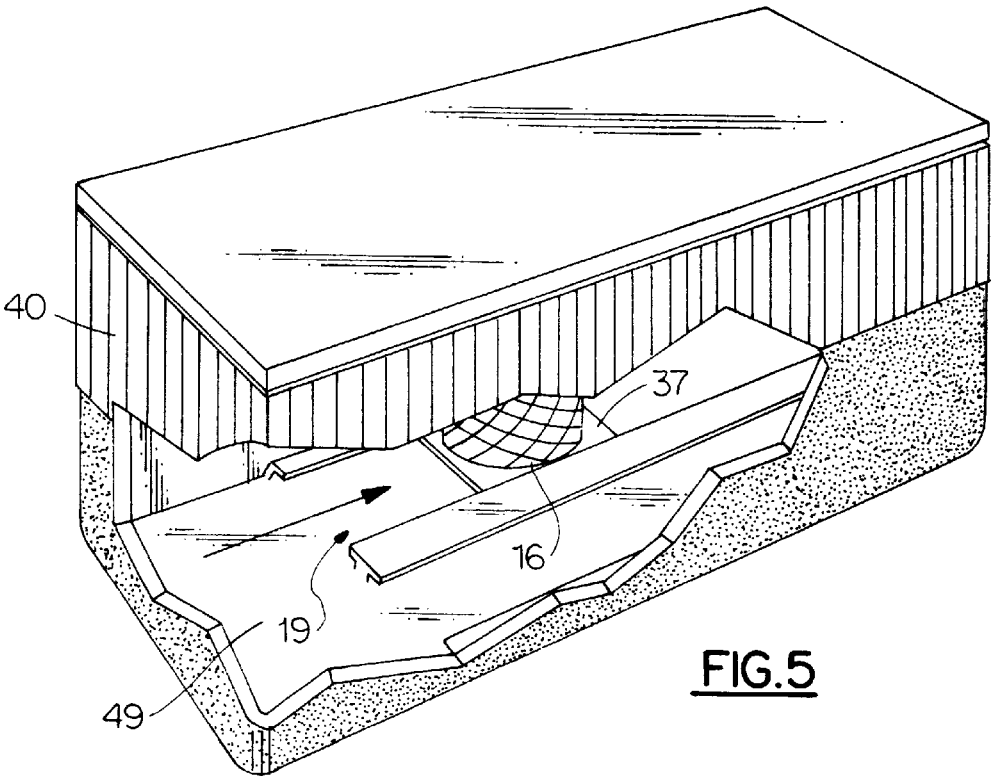
FIG. 5 is a cutaway perspective view of the cooling apparatus of the present invention.

Turning to FIG. 5, the channels 19 do not necessarily have to be formed in a separate base 13. As shown in an alternate embodiment of the invention, the channel 19 can be integrally formed in a surface 49 inside the cooler 40.

Figure 6:
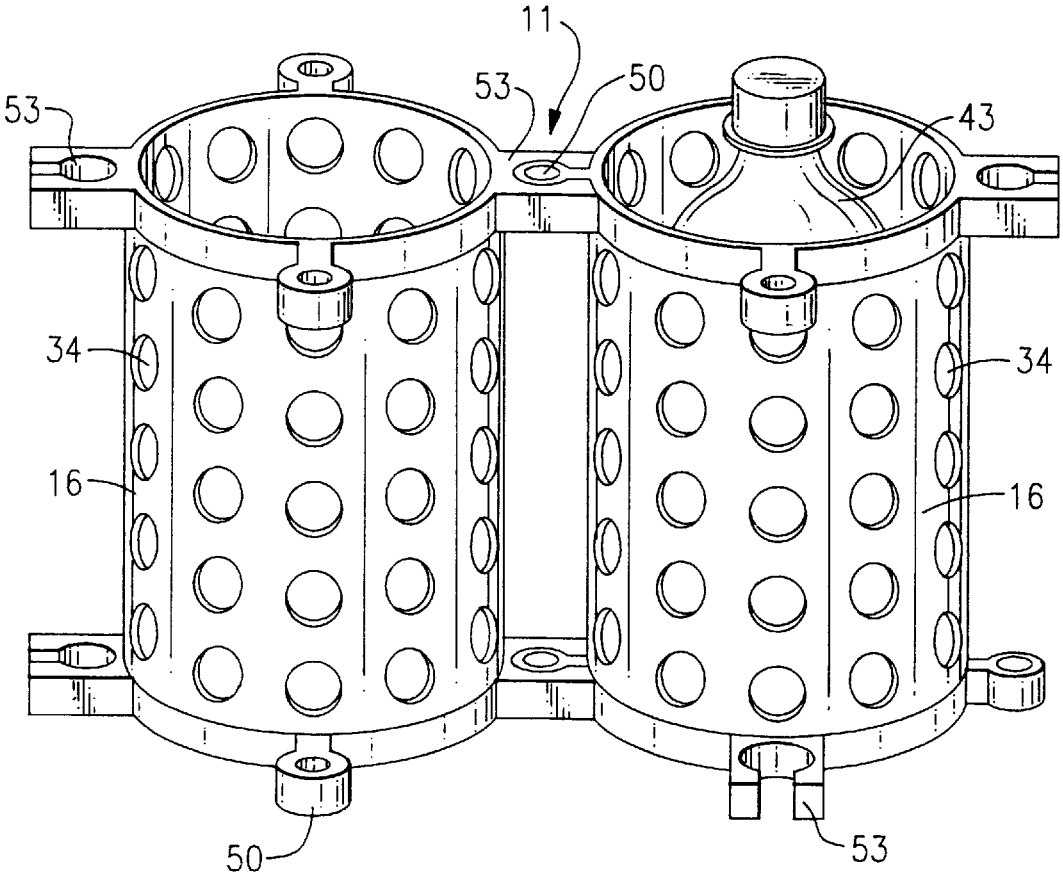
FIG. 6 is a perspective view of an alternate embodiment of the present invention.

In FIG. 6, an alternate embodiment of the invention shows an interconnecting structure 11 that comprises a male quick connector 50 and a female quick connector 53. The male and female quick connectors 50, 53 preferably are molded integrally onto the tubular members 16. The male quick connectors 50 frictionally fit into the female quick connectors 53, such that the tubular members 16 can be coupled together and/or separated easily. The connectors 50, 53 are disposed on all sides of the tubular members 16 such that several tubular members 16 can be coupled together in modular fashion.

Accordingly, the present invention offers several advantages, including the ability to easily remove and then reinsert "economy" size beverage containers into a portable cooler. Another advantage is that the insert provides the flexibility to adapt to use with one or more beverage containers such that no space inside the cooler is wasted and such that cooling efficiency is maximized.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A cooling apparatus, comprising:

a plurality of tubular members having a flange disposed at a first end of each said tubular member and capable of receiving a container to be cooled through an opening at a second end opposite the first end, the tubular member surrounding the container;

a portable cooler having a bottom wall, a plurality of side walls, and an opening at a first end of the side walls, the portable cooler having a channel defined therein, the channel being formed between a bottom surface of the cooler and a pair of opposed protruding members that extend above and substantially parallel to the bottom surface, the channel sized to he capable of receiving each flange such that each of the plurality of tubular members is capable of sliding into the channel and being positioned in a plurality of locations along the length of the channel; and, wherein the flange is wider than the distance between the opposed protruding members such that the flange is captured by the opposed protruding members and guided substantially along a longitudinal plane substantially parallel to the bottom wall.

2. The cooling apparatus of claim 1, wherein the tubular members have a plurality of apertures disposed thereon.

3. In combination:

a cooler having a bottom wall, a plurality of side walls, and an opening at a first end of the side walls;

a plurality of tubular members having a flange disposed at a first end of each said tubular member and capable of receiving a container object to be cooled through an opening at a second end opposite the first end, the tubular member surrounding the container; and, a base supported on the bottom wall of the cooler and having at least one channel defined therein, the channel disposed substantially parallel to the bottom wall of the cooler, the channel being formed between a bottom surface of the base and a pair of opposed protruding members that extend above and parallel to the bottom surface, the channel sized to be capable of receiving each flange such that each of the plurality of tubular members is capable of sliding into the channel and being positioned in a plurality of locations along the length of the channel; and, wherein the flange is wider than the distance between the opposed protruding members such that the flange is captured by the opposed protruding members and guided along a longitudinal plane substantially parallel to the bottom wall.

4. The cooler insert of claim 3, wherein the tubular members slide onto the base such that the position of the tubular member on the base is adjustable.

5. The cooler insert of claim 3, wherein a first end and a second end of the base are open such that the tubular members are capable of sliding onto the base from either end.

6. A method of organizing articles inside a portable cooler comprising the steps of:

providing a plurality of tubular members having a flange disposed at a first end of each said tubular member and capable of receiving a container to be cooled through an opening at a second end opposite the first end, the tubular member surrounding the container;

providing a portable cooler having a bottom wall, a plurality of side walls, and an opening at a first end of the side walls, the portable cooler having a channel defined therein, the channel being formed between a bottom surface of the cooler and a pair of opposed protruding members that extend above and substantially parallel to the bottom surface, the channel sized to be capable of receiving each flange such that each of the plurality of tubular members is capable of sliding into the channel and being positioned in a plurality of locations along the length of the channel;

wherein the flange is wider than the distance between the opposed protruding members such that the flange is captured by the opposed protruding members and guided substantially along a longitudinal plane substantially parallel to the bottom wall;

arranging the tubular members inside the portable cooler;

inserting a containerized beverage into one of the tubular members; and, placing the cooling medium around the tubular members.

* * * * *